US006747543B2

(12) United States Patent
Lim

(10) Patent No.: US 6,747,543 B2
(45) Date of Patent: Jun. 8, 2004

(54) RESISTOR FOR DRIVING MOTOR FOR AIR CONDITIONER BLOWER

(75) Inventor: Peong Ju Lim, Qwangmyeong (KR)

(73) Assignee: Dong Ah Electronics Components Co., LTD, Gyonggi-do (KR)

( * ) Notice: Subject to any disclaimer, the term of this patent is extended or adjusted under 35 U.S.C. 154(b) by 0 days.

(21) Appl. No.: 10/288,789

(22) Filed: Nov. 6, 2002

(65) Prior Publication Data

US 2003/0184429 A1 Oct. 2, 2003

(30) Foreign Application Priority Data

Apr. 2, 2002 (KR) ..... 2002-9924 U
Jun. 7, 2002 (KR) ..... 2002-32025

(51) Int. Cl.[7] ..... H01C 13/00

(52) U.S. Cl. ..... 338/50; 338/220; 338/221; 338/51; 338/53; 338/58; 338/48; 338/239; 338/260; 338/325

(58) Field of Search ..... 338/50, 51, 53, 338/52, 204, 254, 260, 325, 220, 221, 239, 235, 48

(56) References Cited

U.S. PATENT DOCUMENTS 2,457,143 A * 12/1948 Gilliver ..... 338/254
3,671,858 A * 6/1972 Knudsen et al. ..... 324/697
4,935,717 A * 6/1990 Osawa et al. ..... 338/51
5,408,575 A * 4/1995 Morris ..... 388/830
5,550,527 A * 8/1996 Lee ..... 338/50
5,703,561 A * 12/1997 Yamamoto et al. ..... 338/53
5,859,581 A * 1/1999 Morris ..... 338/50
6,018,288 A * 1/2000 Waite et al. ..... 338/254
6,069,553 A * 5/2000 Black, III et al. ..... 338/215
6,173,487 B1 * 1/2001 Murata et al. ..... 29/619
6,510,605 B1 * 1/2003 Smejkal et al. ..... 29/619

* cited by examiner

*Primary Examiner*—Karl D. Easthom
(74) *Attorney, Agent, or Firm*—F. Chau & Associates, LLP

(57) ABSTRACT

A resistor for driving a motor for an air conditioner blower is provided, in which internal resistance bodies are stacked over one after another between insulation plates in the resistor, to accordingly reduce the volume of the entire of the resistor is reduced, and the resistance bodies are separated into a plurality of metal thin plates not a single plate and stacked over one after another, to thereby increase a line width. Also, a temperature fuse is disposed externally. The air conditioner fan blower motor driving resistor is obtained by stacking resistance bodies made of at least two metal thin plates over one after another. The resistance bodies are formed of an independent resistance body forming a second resistance body and a third resistance body on two separate thin plates, and another independent resistance body forming a first resistance body on another thin plate. The resistor is formed of the resistance bodies of a stacking structure in which the resistor is divided into three or more to thereby form respective independent layers. Since the resistance bodies in the resistor are divided into a number of sheets, the line width of each resistance body in each thin plate becomes broad to thereby reduce the volume of the resistor as well as to enhance a durability. Also, a concentrative overheat can be prevented in a particular portion of the resistor, and a thermal emission is facilitated. Also, since a temperature fuse can be assembled externally from a thermal radiator, a resistor assembly structure can be simple.

13 Claims, 13 Drawing Sheets

FIG. 12B(PRTOR ART)

FIG. 13

| CIRCUIT / RESISTANCE | | 1STEP (R1+R2+R3) | 2STEP (R2+R3) | 3STEP (R3) |
|---|---|---|---|---|
| R1 | 1.0[Ω] | 30[W] | 0 | 0 |
| R2 | 0.6[Ω] | 18.2[W] | 60[W] | 0 |
| R3 | 0.35[Ω] | 10.6[W] | 35[W] | 140[W] |
| TOTAL POWER CONSUMPTION | | 60[W] | 95[W] | 140[W] |

RESISTOR FOR DRIVING MOTOR FOR AIR CONDITIONER BLOWER

BACKGROUND OF THE INVENTION

1. Field of the Invention

The present invention relates to a resistor for driving a motor for an air conditioner blower for use in an air ventilation unit for an automobile in order to control a rotational speed of the blower motor, and more particularly, to an air conditioner blower motor driving resistor in which resistance bodies made of metal thin plates are separated into two or more sheets of resistance bodies and stacked over one after another together with insulation plates, and a temperature fuse is externally disposed.

2. Description of the Related Art

Various types of resistors for driving a motor for an air conditioner blower are known.

FIG. 1 is a perspective view showing an example of a conventional resistor for driving a motor for an air conditioner blower. FIG. 2 is an exploded perspective view of the FIG. 1 conventional resistor. FIG. 3 is a perspective view showing another example of a conventional resistor for driving a motor for an air conditioner blower. FIG. 4 is an exploded perspective view of the FIG. 3 conventional resistor. FIG. 7C illustrates a resistance body of a single plate structure for use in a conventional air conditioner blower motor driving resistor. FIG. 12B schematically shows a resistance body realized in a conventional air conditioner blower motor driving resistor.

Referring to FIGS. 1 through 4, 7C and 12B, a conventional air conditioner blower motor driving resistor includes a connector 20 for connecting to an air ventilation unit and a resistor 10 having a resistance body 11.

The resistor 10 includes a thermal radiator 13 for emitting heat of the resistance body 11, a cover member 14 for covering the resistor 10, and insulation plates 12 installed at both sides of the resistance body 11 in order to insulate the resistance body 11, in which a soldering portion 30 being an overheat prevention unit is soldered and connected between the lower terminals.

The resistance body 11 in the resistor 10 includes a common terminal 21 and three select terminals 22, 23 and 24, in which a resistance circuit is formed so that respectively different resistance values exist between the terminals 22, 23 and 24.

Hereinafter, a resistor between the common terminal 21 and the first select terminal 22 is denoted as R3, a resistor between the first select terminal 22 and the second select terminal 23 is denoted as R2, and a resistor between the second select terminal 23 and the third select terminal 24 is denoted as R1. Also, the rotational speed of the blower motor is called a first step speed, a second step speed and a third step speed from the lowest speed.

That is, if the common terminal 21 and the third select terminal 24 are selected, the resistance value becomes R1+R2+R3. As a result, since the resistance value becomes the largest, the rotational speed of the blower motor becomes the lowest speed, that is, the first step speed. If the common terminal 21 and the second select terminal 23 are selected, the resistance value becomes R3+R2. As a result, the rotational speed of the blower motor becomes the second step speed. If the common terminal 21 and the third select terminal 22 are selected, the resistance value becomes R3. As a result, the rotational speed of the blower motor becomes the three step speed which is the highest speed.

In the case of the conventional resistance body, the respective resistance values are formed on only a single metal thin plate. As a result, as shown, the line width of the resistance body 11 is very narrow and the interval between the resistance circuits is also narrow. Accordingly, the short circuit phenomenon frequently occurs to raise an out-of-trouble. Also, the intensity is lowered to make it difficult to fabricate a resistor.

That is, as shown in FIGS. 7C and 12B, in order to have a resistance value in a limited area, a portion denoted as "a" has an extremely narrow line width in case of R1. As illustrated in the following equation, $$R=\rho\times(L/A)[\Omega]$$

(R: resistance, ρ: specific resistance, A: cross-sectional area, and L: the length of a circuit), since a resistance is proportional with a length, and inversely proportional with a cross-sectional area, a portion "a" having a cross-sectional area of such a narrow line width can be easily overheated. Accordingly, the resistance value can be varied due to the heat. As a result, the resistance value becomes a resistance value differing from a design resistance value, to thus raise an operational error.

Meanwhile, a heat generated from a resistor circuit will be described with reference to the following equation.

$$H=0.24\times I^2RT[cal]$$

(I: current, R: resistance, and T: unity time)

A heat generated during operation of a resistor, called a Joule's heat is proportional with a square of current. As described above, the Joule's heat is inversely proportional with a cross-sectional area of the circuit. In order to reduce a current density per a unity area, a circuit width should be increased to dissipate the generated heat. This should be reflected on designing and fabricating a circuit and a heat radiator.

That is, as the width of a thin plate forming a resistance circuit is narrower, a possibility of breaking of wires becomes higher. As the width of a thin plate forming a resistance circuit is wider, a possibility of breaking of wires becomes lower. Thus, a structural change necessary for improving the line width of each resistor has been required.

As illustrated in the Table of FIG. 13, an electric power of the resistance in each resistance body is 10.6 W for R3, 18.2 W for R2 and 30 W for R1 in case of a first step speed, 35 W for R3, 60 W for R2 and 0 W for R1 in case of a second step speed, and 140 W for R3, 0 W for R2 and R1 in case of a three step speed. In this case, it can be seen that the electric power at the R1 and R2 sides becomes much smaller than that at the R3 side. In order to thermally radiate the entire resistance body, a thermally radiating structure without considering a heat generating quantity for each resistance body may cause a loss of materials for fabricating components.

In particular, as shown in FIGS. 3 and 4, a cylindrical temperature fuse has been used as an overheat preventive unit in the conventional art. However, since such a resistor structure adopts a structure of soldering and connecting the resistance bodies at the state where the outer upper portion of the cover member is cut, it may cause a short circuit with the inner wall of the thermal radiator. Also, since dispersion of a resistance value R3 is large, the structure of the resistor is complicated, and the fabrication process is difficult, a production cost becomes high and a failure rate level is high.

Also, since a conventional resistance body of a copper-nickle alloy needs a high material cost. It is nearly impossible to be applied as a semiconductor material since dispersion of the resistance value is high. Also, since a temperature characteristic is inferior and a mechanical strength is not good in the processes of the film etching and the resistor assembly.

SUMMARY OF THE INVENTION

To solve the above problems of the conventional air conditioner blower motor driving resistor, it is an object of the present invention to provide an air conditioner blower motor driving resistor, in which resistance bodies are separated into a number of metal thin plates and stacked over one after another, to thereby obtain a desired resistance value and reduce volume of the resistor to be more compact, and to thereby secure line widths in resistance circuits and intervals between the resistance circuits in order to reduce a short circuit frequency during overheat and suppress a failure rate.

It is another object of the present invention to provide an air conditioner blower motor driving resistor in which a thermal radiator is minimized and removed in a resistor side having a small amount of electric power proportional with a heat emission amount, and is designed and disposed in a R3 side having a large amount of electric power, in a manner that a thermal radiating structure is not included in a portion having a small amount of heat emission.

It is still another object of the present invention to provide an air conditioner blower motor driving resistor of an iron-nickle alloy which is more excellent and less material cost than a copper-nickle alloy, in which a dispersion of resistance value is low, a temperature characteristic is excellent, and a mechanical strength is excellent in the processes of film etching and resistor assembly, so as to be used as a semiconductor material.

It is yet another object of the present invention to provide an air conditioner blower motor driving resistor capable of assembling an overheat prevention unit externally from a thermal radiator and securing a stability of designing with respect to an assembly structure of a short circuit preventive unit.

To accomplish the above object of the present invention, there is provided a resistor for driving a motor for an air conditioner blower, the air conditioner blower motor driving resistor comprising: a resistor unit obtained by stacking insulation plates and resistance bodies alternately over one after another, in an inner accommodating area while combining protrusions formed along the upper and left and right portions of a resistor cover member forming an accommodating space with a thermal radiator; and a connector unit on the lower portion of which power source terminals are covered with a connector cover member and on the upper portion of which terminals soldered and connected with the resistance bodies stand erect.

Preferably, the resistor unit comprises a first independent resistance body and a second independent resistance body obtained by combining two resistance bodies each having a small resistance value.

Preferably, the resistor unit in the resistor can be formed in a multi-layer, for example, three-layer resistance bodies which are independently separated, respectively.

Preferably, the material of the resistance body in the resistor is an iron-nickle alloy.

Preferably, the air conditioner blower motor driving resistor further comprises a temperature fuse which is short circuited during overheat through the resistance bodies, in order to protect an inner circuit.

In the air conditioner blower motor driving resistor comprising the connector unit and the resistor unit, the resistance bodies are alternately formed in a multi-layer form between the insulation plates.

BRIEF DESCRIPTION OF THE DRAWINGS

The above objects and other advantages of the present invention will become more apparent by describing the preferred embodiment thereof in more detail with reference to the accompanying drawings in which:

FIG. 12B schematically shows a resistance body realized in a conventional air conditioner blower motor driving resistor; and FIG. 13 is a table representing a power consumption with respect to a resistance of a representative air conditioner blower motor driving resistor.

DETAILED DESCRIPTION OF THE INVENTION

Preferred embodiments of the present invention will be described with reference to the accompanying drawings.

Figure 1:
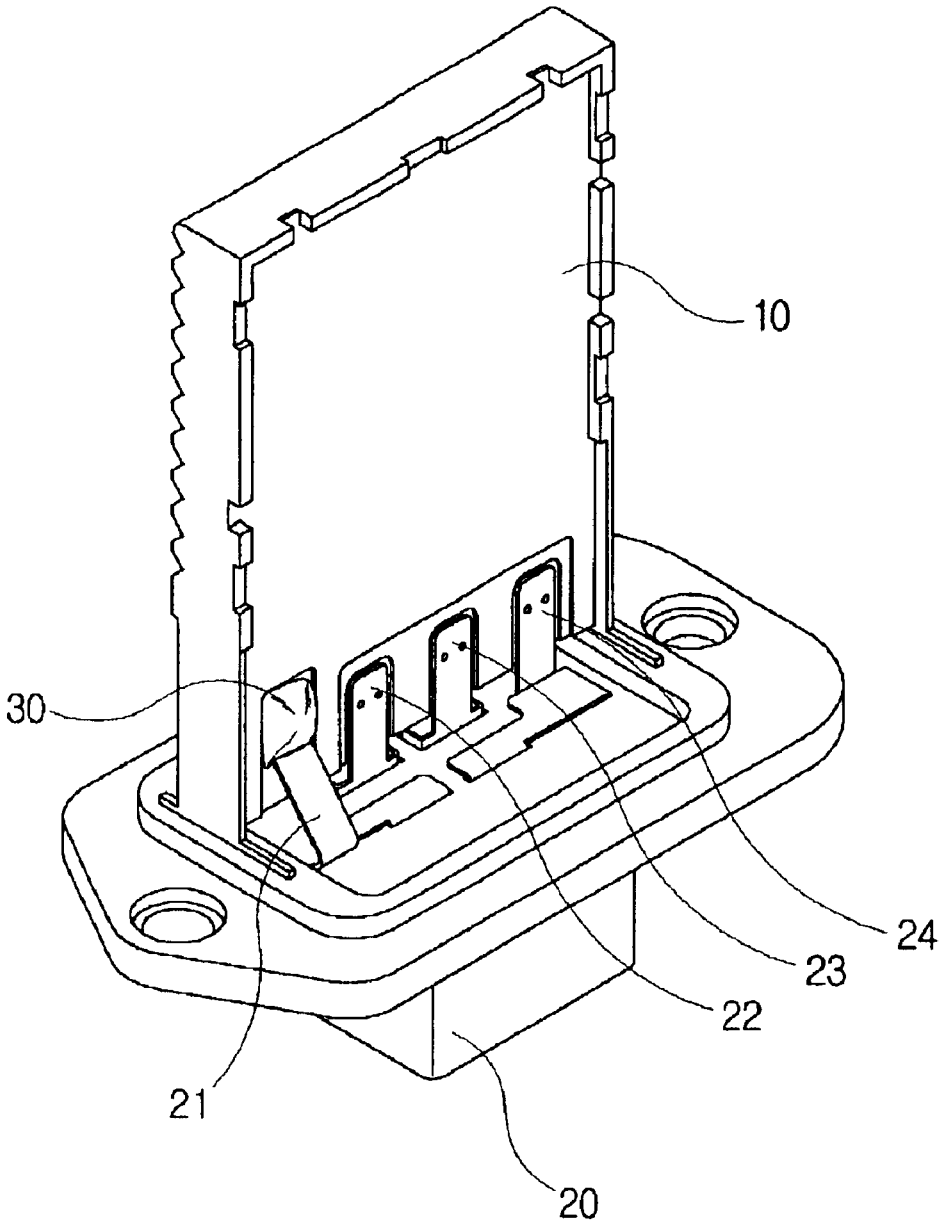
FIG. 1(PRIOR ART)
FIG. 1 is a perspective view showing an example of a conventional resistor for driving a motor for an air conditioner blower.
Figure 2:
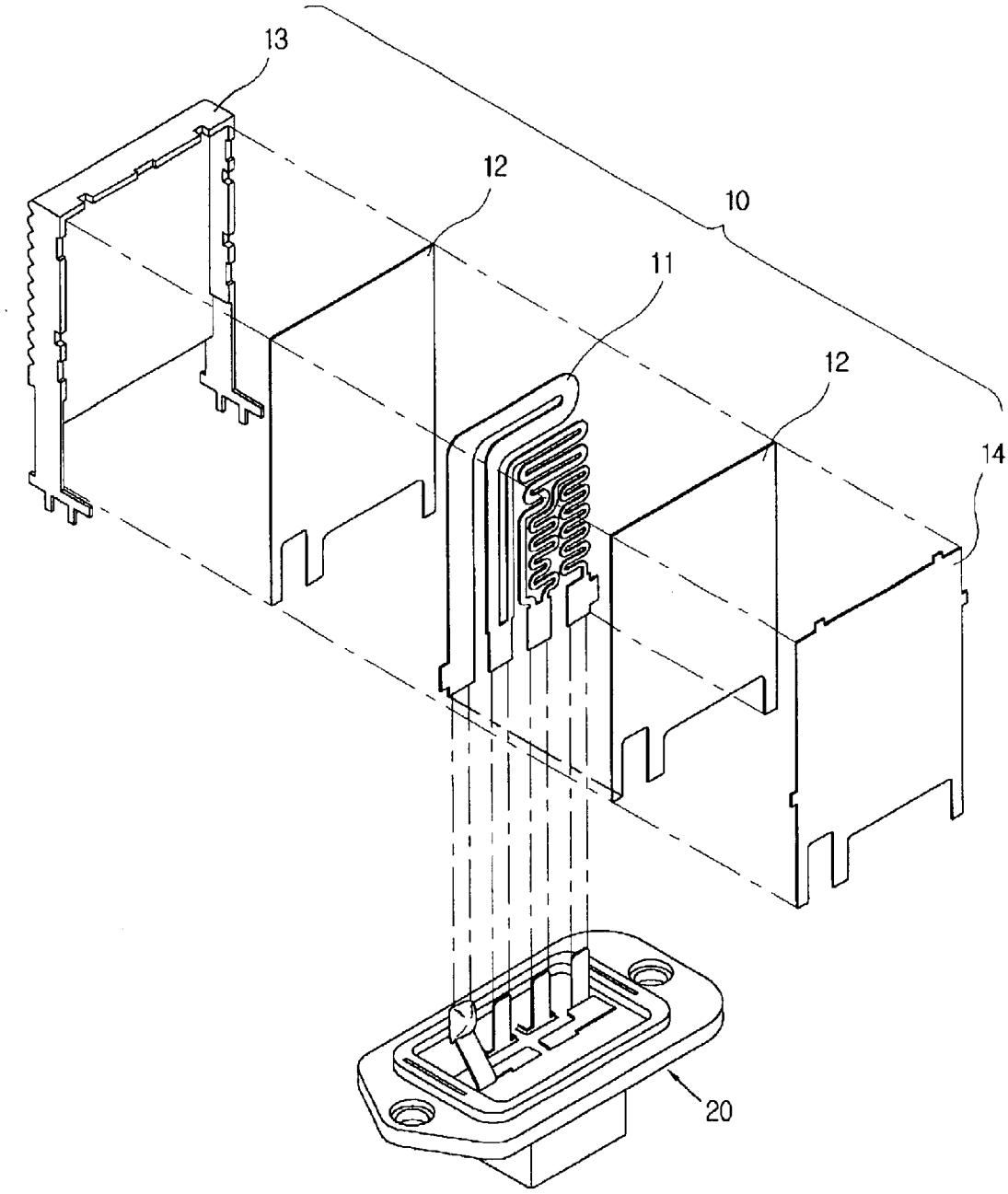
FIG. 2(PRIOR ART)
FIG. 2 is an exploded perspective view of the FIG. 1 conventional resistor.
Figure 3:
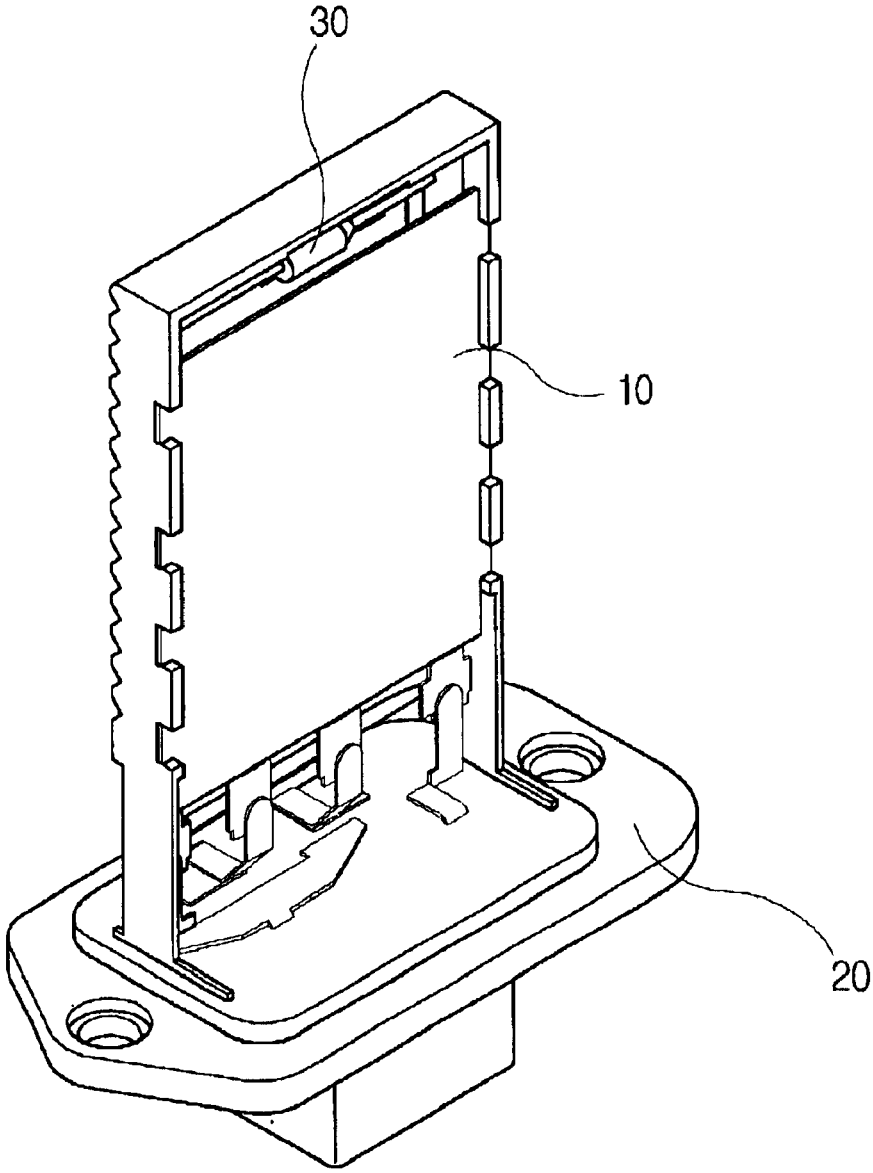
FIG. 3(PRIOR ART)
FIG. 3 is a perspective view showing another example of a conventional resistor for driving a motor for an air conditioner blower.
Figure 4:
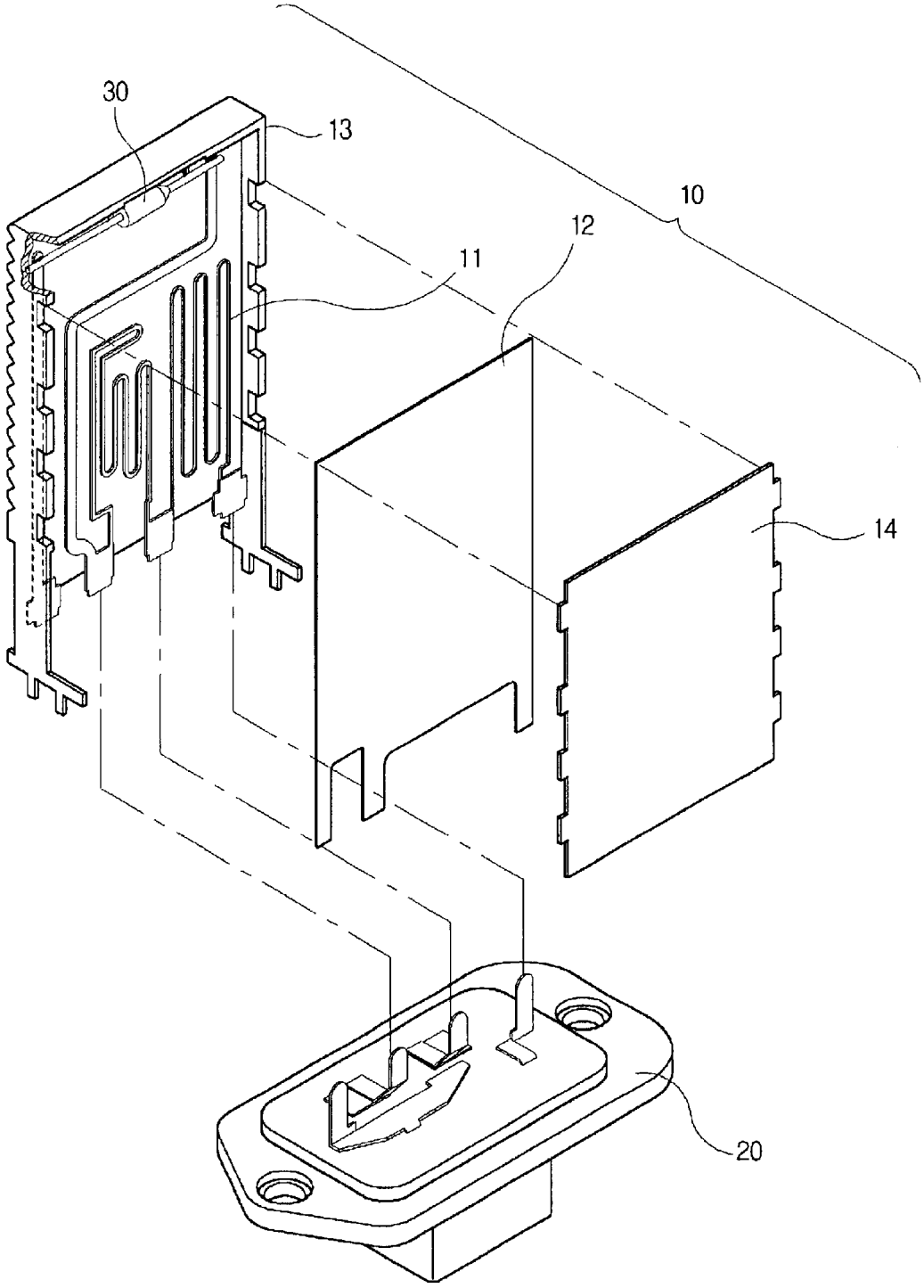
FIG. 4(PRIOR ART)
FIG. 4 is an exploded perspective view of the FIG. 3 conventional resistor.
Figure 5:
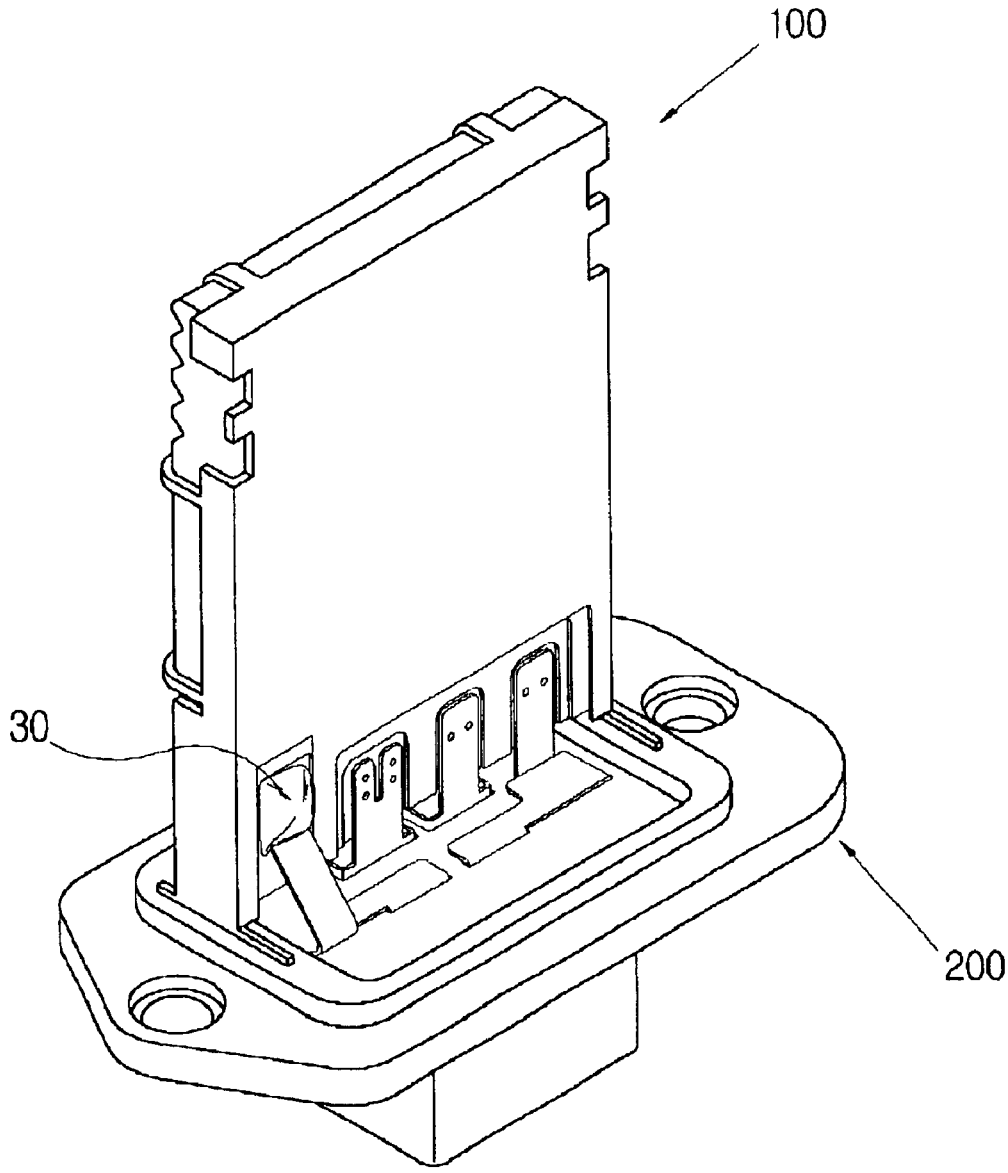
FIG. 5 is a perspective view showing a resistor for driving a motor for an air conditioner blower, according to a first embodiment of the present invention.
Figure 6:
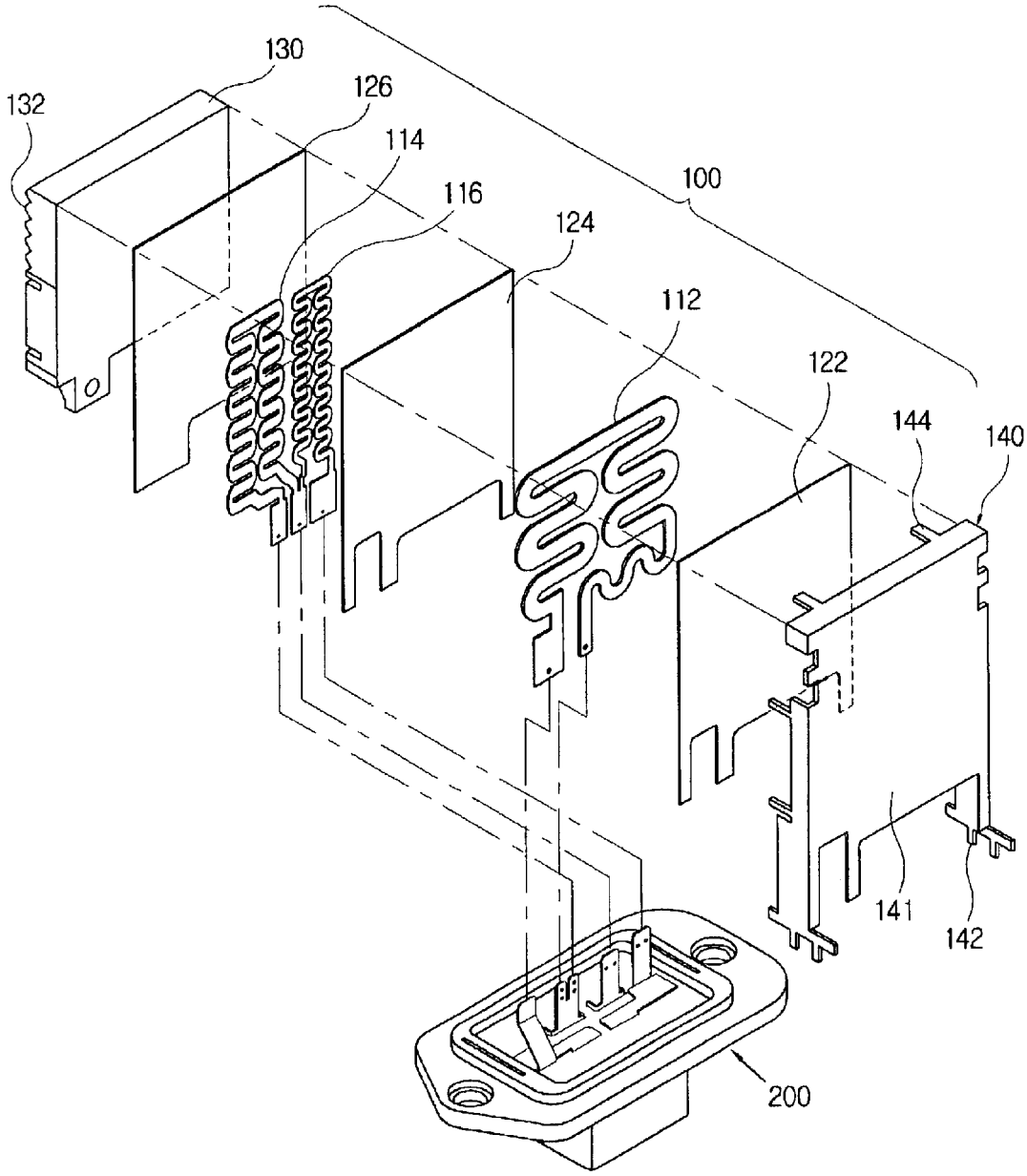
FIG. 6 is an exploded perspective view of the FIG. 5 resistor.
Figure 7A:
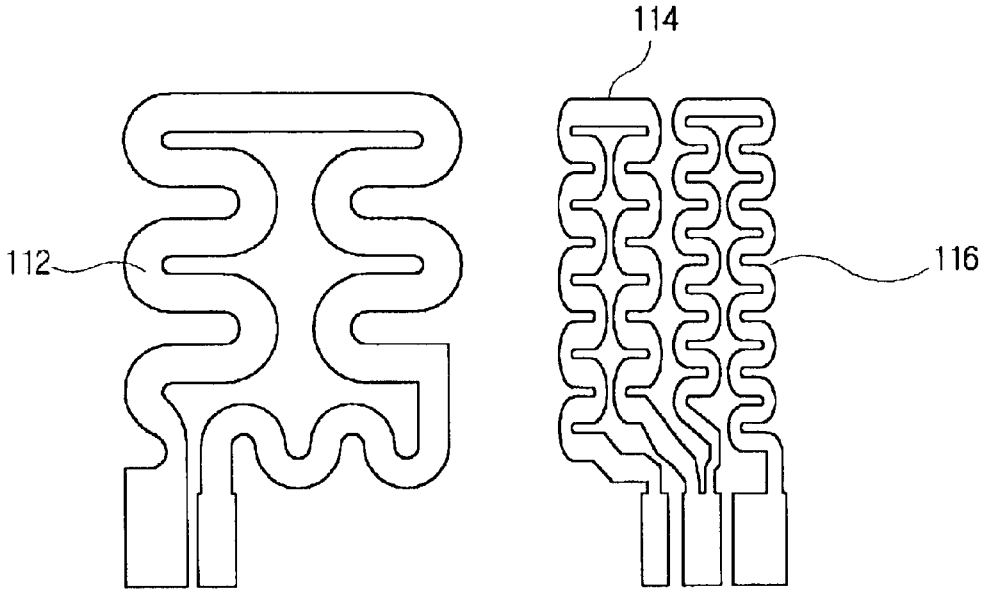
FIG. 7A illustrates resistance bodies for use in the air conditioner blower motor driving resistors according to first and second embodiments of the present invention, respectively.
Figure 11A:
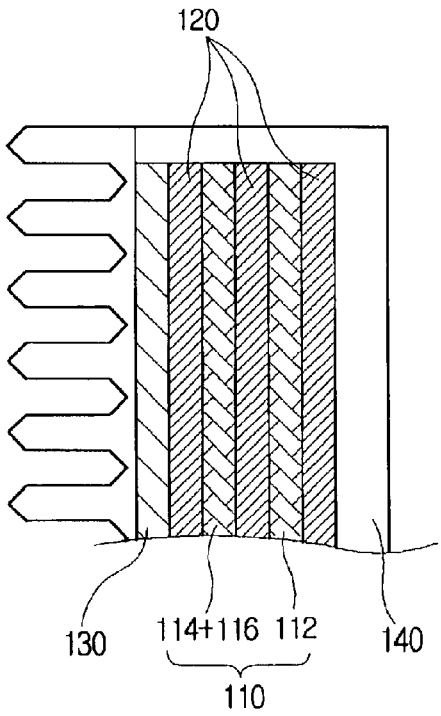
FIGS. 11A and 11B are enlarged sectional views of the air conditioner blower motor driving resistors according to the present invention.

FIG. 5 is a perspective view showing a resistor for driving a motor for an air conditioner blower, according to a first embodiment of the present invention. FIG. 6 is an exploded perspective view of the FIG. 5 resistor. FIG. 7A illustrates resistance bodies for use in the air conditioner blower motor driving resistor according to a first embodiment of the present invention. FIG. 11A is a schematic sectional view of the air conditioner blower motor driving resistor according to the first embodiment of the present invention.

Referring to FIGS. 5, 6, 7A and 11A, a resistor according to a first embodiment of the present invention includes a resistor unit 100 and a connector unit 200 largely.

The resistor unit 100 includes a thermal radiator 130, insulation plates 120, resistance bodies 110, and a cover member 140.

Among them, the resistance bodies 110 includes an independent resistance body 112 having the smallest resistance value R3, and a third resistance body 116 having the largest resistance value R1 combined with a second resistance body 114 having the intermediate resistance value R2.

The cover member 140 includes a support leg 142 in the lower portion at each side. An accommodating space 141 is formed in the inner side from the cover member 140. Protrusions 144 are formed along the edges of the upper and left and right sides in the accommodating space 141.

The thermal radiator 130 includes a plurality of heat radiating fins formed outwards from the resistor unit 100.

The insulation plates 120 includes a first insulation plate 122 whose one surface contacts the inner side of the cover member 140, a second insulation plate 124 disposed between the resistance body 112 and the resistance bodies 114 and 116, and a third insulation plate 126 positioned between the resistance bodies 114 and 116 and the thermal radiator 130.

Since the specific structure of the connector unit 200 is well known, the detailed description thereof will be omitted.

When the resistor according to the present invention is assembled, the first insulation plate 122, the first resistance body 112, the second insulation plate 124, the resistance body in which the second resistance body 114 and the third resistance body 116 are combined, the third insulation plate 126, and the thermal radiator 130 are stacked over one after another, in turn from the inner accommodating space 141 of the cover member 140 on both lower portions of which the support legs 142 are formed, and then the protrusions 144 formed on the cover member 140 are bent to be combined with the thermal radiator 130. In this case, it is preferable that the thermal radiator as well as the insulation plates are extensively formed in the lower portion of the resistor, in order to insulate the separated resistance bodies.

The reason why the third resistance body R3 is stacked only at the thermal radiator 130 is because much current flows through the third resistance body R3 irrespective of the select terminals connected with the third resistance body R3, to thereby generate much heat.

Also, it is preferable that an iron-nickle alloy whose resistance change rate is lower, intensity is more excellent and unit price is lower than an existing copper-nickle alloy is used as the resistance bodies.

Figure 8:
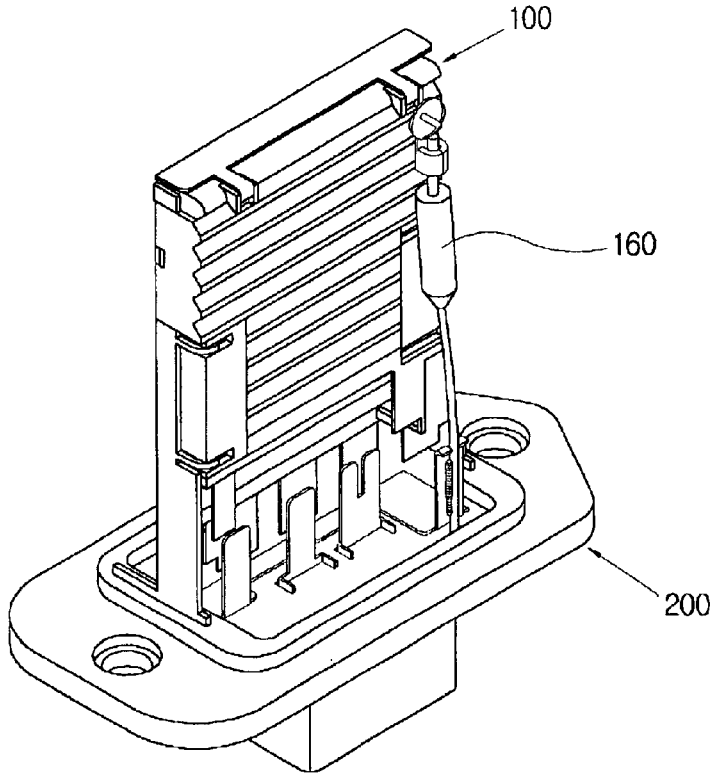
FIG. 8 is a perspective view showing a resistor for driving a motor for an air conditioner blower, according to a second embodiment of the present invention.
Figure 9:
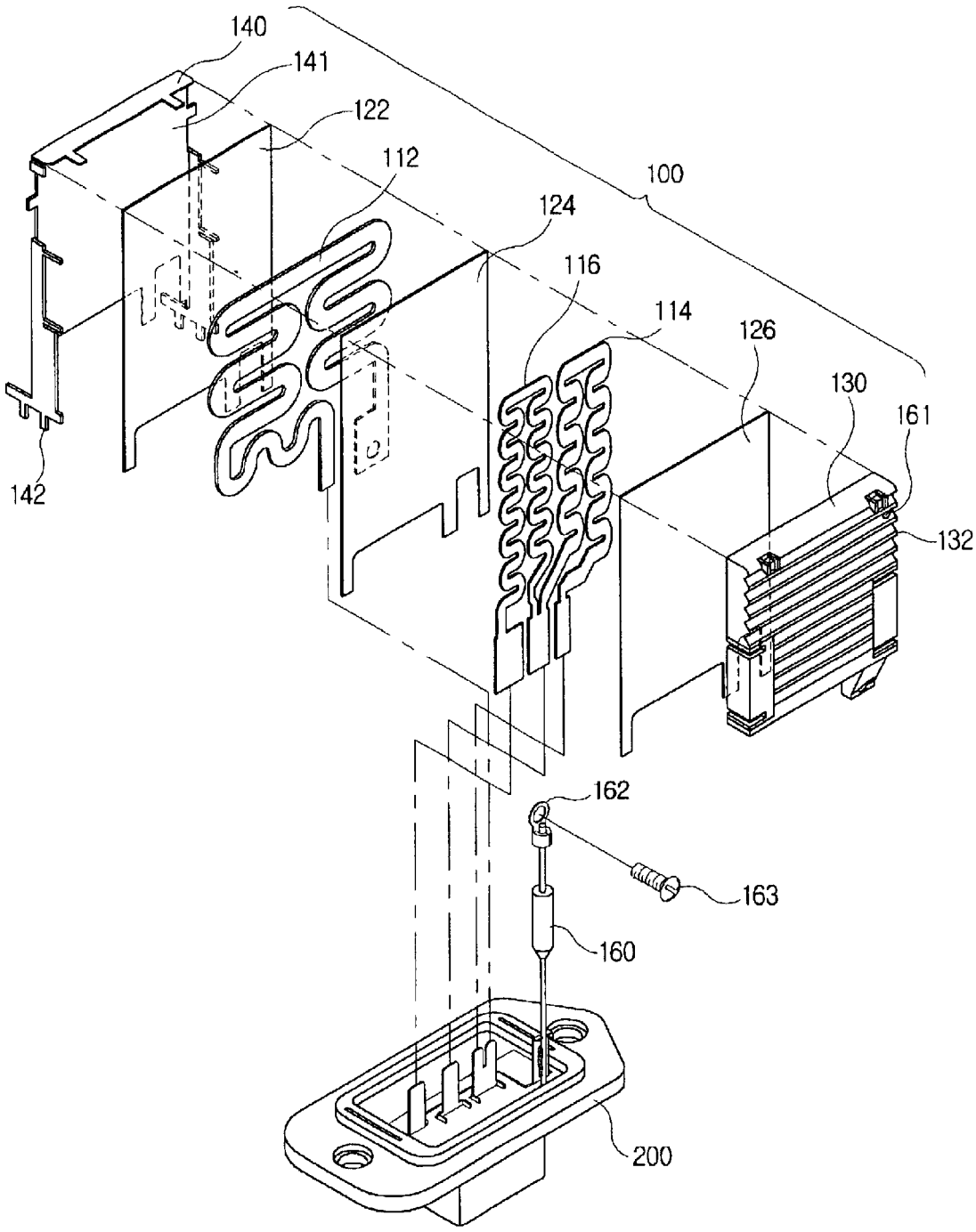
FIG. 9 is an exploded perspective view of the FIG. 8 resistor.

FIG. 8 is a perspective view showing a resistor for driving a motor for an air conditioner blower, according to a second embodiment of the present invention, and FIG. 9 is an exploded perspective view of the FIG. 8 resistor. The sectional view of the air conditioner blower motor driving resistor according to the second embodiment of the present invention is same as that of the FIG. 11A first embodiment, and the structure of the resistance bodies of the second embodiment of the present invention is same as that of the FIG. 7A first embodiment.

The resistor according to the second embodiment of the present invention also includes a resistor unit 100 and a connector unit 200 largely.

The resistor unit 100 includes a thermal radiator 130, insulation plates 120, resistance bodies 110, a cover member 140, and a temperature fuse 160 being an overheat preventive unit.

The resistance bodies 110 includes an independent resistance body 112 and a third resistance body 116 combined with a second resistance body 114.

The cover member 140 includes a support leg 142 in the lower portion at each side. An accommodating space 141 is formed in the inner side from the cover member 140. Protrusions 144 are formed along the edges of the upper and left and right sides in the accommodating space 141.

The thermal radiator 130 includes a plurality of heat radiating fins formed outwards from the resistor unit 100.

The insulation plates 120 includes a first insulation plate 122 whose one surface contacts the inner side of the cover member 140, a second insulation plate 124 disposed between the resistance body 112 and the resistance bodies 114 and 116, and a third insulation plate 126 positioned between the resistance bodies 114 and 116 and the thermal radiator 130.

In particular, since the temperature fuse 160 is exposed and disposed at the outer side of the thermal radiator 130, the following closed circuit is formed. That is, an upper ring-shaped terminal which is a temperature fuse input terminal is connected to the upper portion of the thermal radiator 130 with a bolt 163 so as to be electrically conducted, the output end of the resistance body 112 is connected to the lower portion of the thermal radiator 130 with a bolt 163, and the output end of the temperature fuse 160 is connected to the terminal of the connector unit 200.

Accordingly, the resistance bodies, a closed circuit is formed from the first terminal of the connector unit 200 to the other terminal of the connector unit through the thermal radiator 130 and the temperature fuse 160.

When the resistor according to the present invention is assembled, the first insulation plate 122, the first resistance body 112, the second insulation plate 124, the resistance body in which the second resistance body 114 and the third resistance body 116 are combined, the third insulation plate 126, and the thermal radiator 130 are stacked over one after another, in turn from the inner accommodating space 141 of the cover member 140 on both lower portions of which the support legs are formed, and then the protrusions 144 formed on the cover member 140 are bent to be combined with the thermal radiator 130. The upper end of the temperature fuse 160 having a ring-shaped contact is connected into a connection hole 161, which has been formed in advance, by using a bolt 163.

Figure 7B:
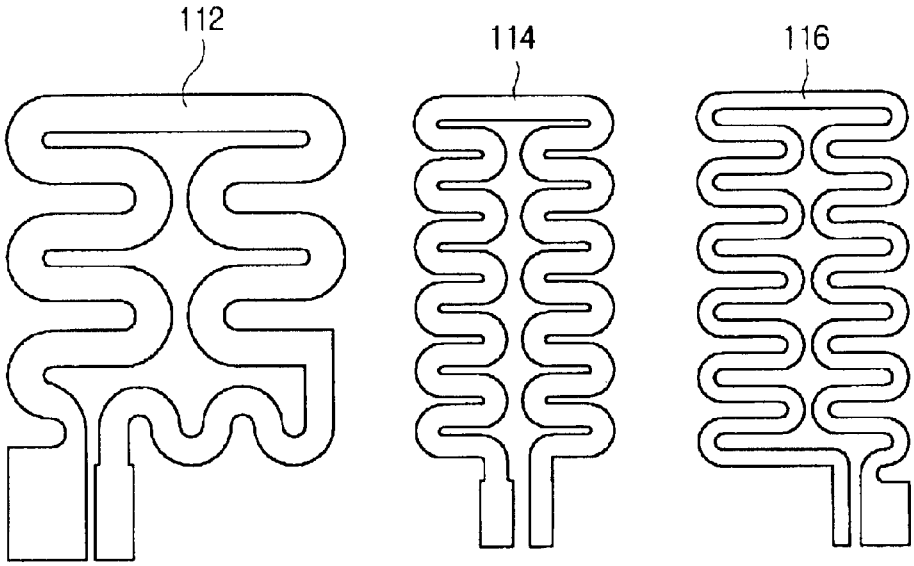
FIG. 7B illustrates resistance bodies for use in the air conditioner blower motor driving resistor according to a third embodiment of the present invention.
Figure 10:
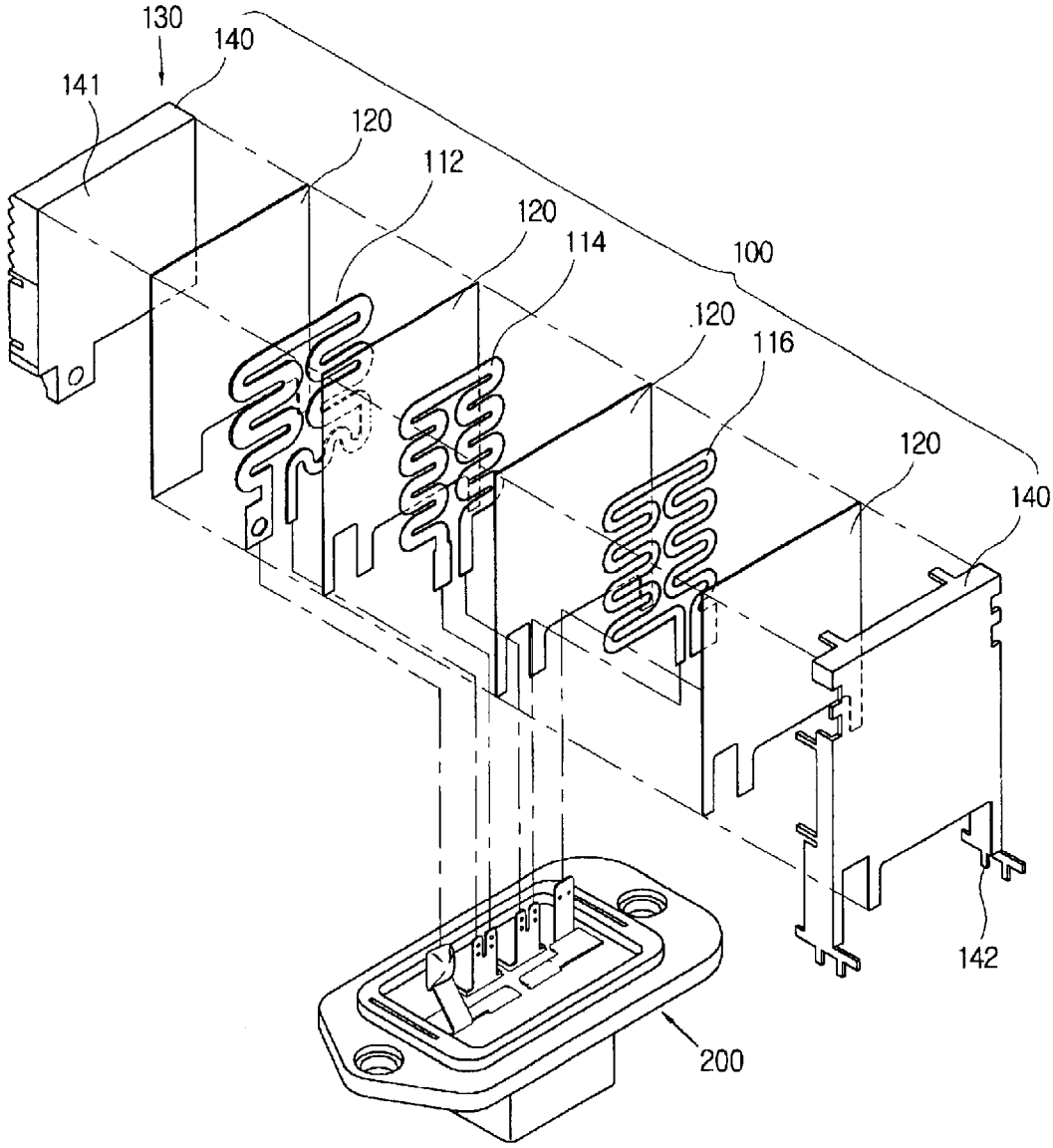
FIG. 10 is an exploded perspective view of an air conditioner blower motor driving resistor according to a third embodiment of the present invention.
Figure 11B:
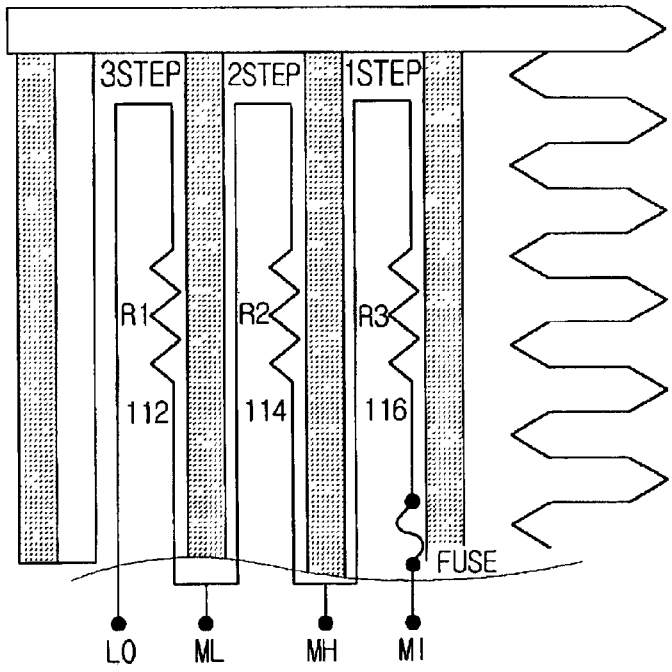

FIG. 10 is an exploded perspective view of an air conditioner blower motor driving resistor according to a third embodiment of the present invention. FIG. 7B illustrates resistance bodies for use in the air conditioner blower motor driving resistor according to a third embodiment of the present invention. FIG. 11B is a schematic sectional view of the air conditioner blower motor driving resistor according to the third embodiment of the present invention.

The resistor according to the third embodiment of the present invention also includes a resistor unit 100 and a connector unit 200 largely.

The resistor unit 100 includes a thermal radiator 130, insulation plates 120, resistance bodies 110, and a cover member 140.

In the third embodiment of the present invention, the resistance bodies 110 includes a resistance body 112, a second resistance body 114 and a third resistance body 116 which are independently separately formed respectively.

The cover member 140 includes a support leg 142 in the lower portion at each side. An accommodating space 141 is formed in the inner side from the cover member 140. Protrusions 144 are formed along the edges of the upper and left and right sides in the accommodating space 141.

The thermal radiator 130 includes a plurality of heat radiating fins formed outwards from the resistor unit 100.

In particular, the insulation plates 120 includes a first insulation plate 122 whose one surface contacts the inner side of the cover member 140, a second insulation plate 124 disposed between the resistance body 112 and the resistance body 114, a third insulation plate 126 positioned between the resistance bodies 114 and 116 and a fourth insulation plate 128 positioned between the resistance body 116 and the thermal radiator 130.

Figure 12A:
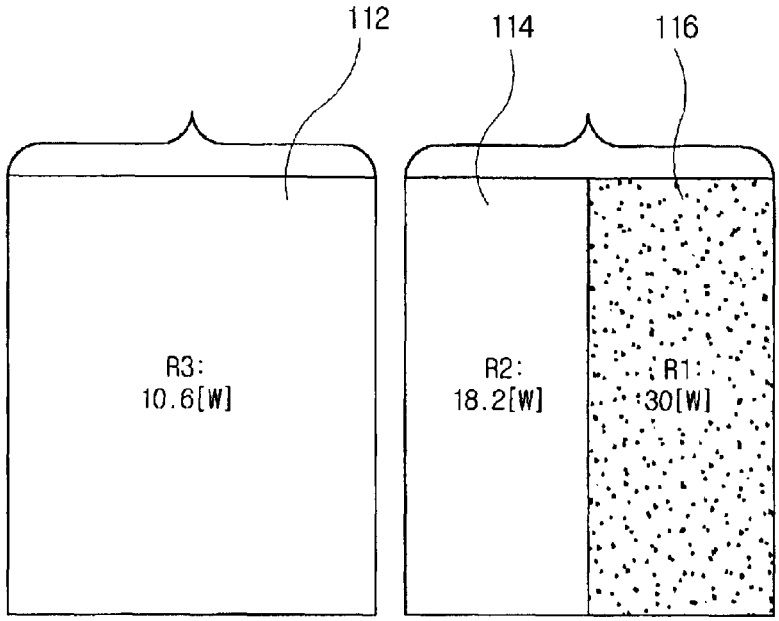
FIG. 12A illustrates a state where a first resistance body and a second resistance body are separated in an air conditioner blower motor driving resistor according to the present invention.
Figure 12A:
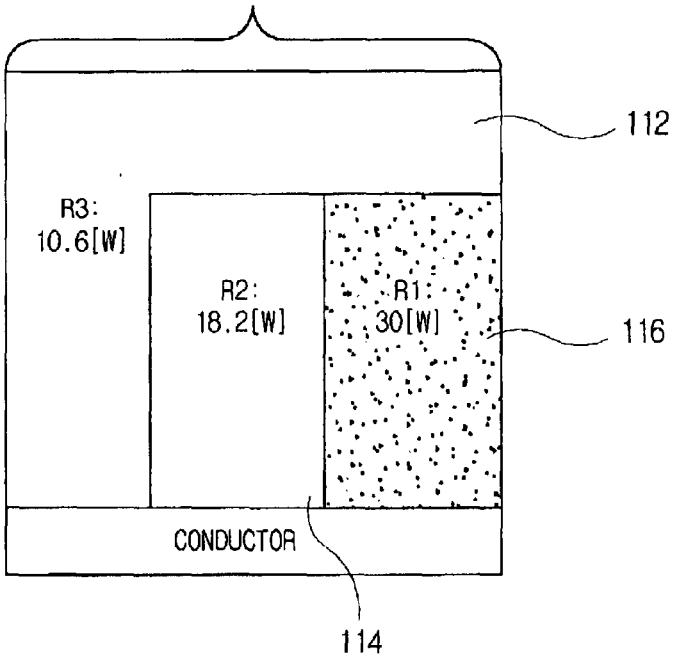

FIG. 12A illustrates a state where a first resistance body and a second resistance body are separated in an air conditioner blower motor driving resistor which represents an example of a circuit indicative of a first step speed according to the present invention. FIG. 12B schematically shows a resistance body realized in a conventional air conditioner blower motor driving resistor. FIG. 13 is a table representing a power consumption with respect to a resistance of a representative air conditioner blower motor driving resistor.

As shown in FIGS. 12A, 12B and 13, the resistance bodies 110 include two independent resistance bodies or three independent resistance bodies, which are stacked between the separated insulation plates. Since the power consumption is the biggest in the first resistance body R3 in the case of the three step circuit of the air conditioner blower motor driving resistor, an amount of heat generation is also the biggest. Thus, since the resistance body R3 is concentratively thermally radiated in the present invention, the thermal radiators need not be disposed at both sides of the resistor as in the conventional case.

Figure 7C:
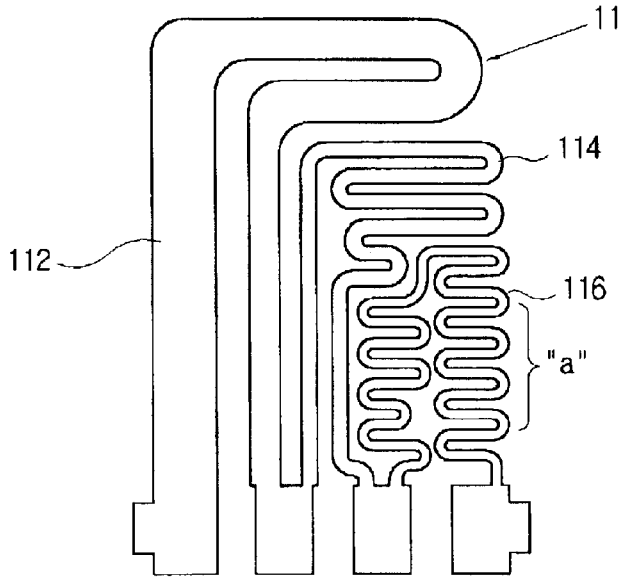
FIG. 7C(PRIOR ART)
FIG. 7C illustrates a resistance body of a single plate structure for use in a conventional air conditioner blower motor driving resistor.

Also, as shown in FIGS. 7C and 12B in the conventional case, since all the resistance bodies are formed in a single metal thin plate, the entire area of the resistor becomes large and thus the line width becomes thin to cause a break-off failure rate to be increased. As shown in FIGS. 7A and 12A in the present invention, the resistance body 116 and the resistance body 114 are respectively independent in the third embodiment of the present invention. As a result, the line width can be extended and thus the line width intensity is reinforced to thereby reduce possibility of breaking of wire due to overheat. Likewise, although the resistance bodies 114 and 116 are combined in the first and second embodiments of the present invention and separated from the resistance body 112, the line width becomes wider than that of the conventional single plate resistance body, to accordingly reduce a failure of breaking of wire due to overheat.

1) As illustrated in the following equation, $$R=\rho\times(L/A)[\Omega]$$

(R: resistance, ρ: specific resistance, A: cross-sectional area, and L: the length of a circuit), since a resistance during operation of a resistor is proportional with a length, and inversely proportional with a cross-sectional area.

2) A heat generated from a resistor circuit will be described with reference to the following equation.

$$H=0.24\times I^2RT[cal]$$

(I: current, R: resistance, and T: unity time)

A Joule's heat generated during operation of a resistor, is proportional with a square of current and as described above, the Joule's heat is inversely proportional with a cross-sectional area of the circuit.

Thus, in order to reduce a current density per a unity area, a circuit width should be increased to dissipate the generated heat. In the conventional case, a portion "a" having a cross-sectional area of such a narrow line width can be easily overheated, and thus the resistance value can be varied due to the heat. As a result, the resistance value becomes a resistance value differing from a design resistance valve, to thus raise an operational error. However, since the resistance bodies are independently separated in the present invention, the line width can be widened to resultantly reduce overheat in comparison with the conventional resistor and decrease an operational error due to the variation of the resistance value.

The air conditioner blower motor driving resistor according to the present invention is same in construction as that of the conventional resistor. As the number of the resistance bodies increases, the number of the insulation plates increases. However, since the resistance bodies are stacked over one after another, the area of the resistance bodies decreases. As a result, the entire volume of the resistor decreases, the weight thereof decreases, and the material cost is reduced, where the thermal radiator 130, the cover member 140 and the insulation plates 120 are stacked over one after another.

As described above, the resistor according to the present invention is embodied by using a number of sheets of metal thin plates. Accordingly, the line width line widths in resistance circuits and intervals between the resistance circuits can be secured. Thus, a short circuit phenomenon caused by being overheated due to current concentrated at a particular portion can be prevented. Also, a mechanical strength can be secured due to the increase of the line width and the thickness in the circuit during overheat and suppress a failure rate.

Also, an error generated during an assembly process is reduced by the secured mechanical strength, and thus an inferiority rate can be reduced.

Also, since the resistance bodies are formed in a stack structure, the volume of the individual resistance body becomes small and thus the volume of the thermal radiator and the insulation plates can be reduced. As a result, the volume and the weight of the entire resistor can be reduced and a cost saving can be accomplished as the material cost is decreased.

Since the resistance bodies are made of an iron-nickle alloy whose dispersion of resistance values depending upon temperatures is low, an air conditioner blower motor driving resistor without having an influence of a temperature change can be provided.

In the present invention, the output end of the inner resistance body R3 and the lower portion of the thermal radiator are connected together with the cover member with bolts in the outer side of the thermal radiator. The one terminal of the temperature fuse is connected to the upper portion of the thermal radiator. Also, the temperature fuse which is an overheat preventive unit is connected to the connection terminal in the connector unit positioned in the outer side of the thermal radiator. Accordingly, the structure of the resistor having the temperature fuse and the fabricating process can be simplified.

What is claimed is:

1. A resistor for driving a motor for an air conditioner blower, the air conditioner blower motor driving resistor comprising:

a resistor unit obtained by stacking insulation plates and resistance bodies alternately over one after another, in an inner accommodating area while combining protrusions formed along an upper and left and right portions of a resistor cover member forming an accommodating space with a thermal radiator;

a connector unit on the lower portion of which power source terminals are covered with a connector cover member and on the upper portion of which terminals soldered and connected with the resistance bodies stand erect; and a temperature fuse having a first and a second terminal, wherein the first terminal of said temperature fuse is fixed with a bolt to a ring-shaped terminal at an outer upper portion of the thermal radiator, to thereby enable a circuit to be formed through the thermal radiator, and wherein a second terminal of said temperature fuse is connected to a negative terminal of the connector, wherein at least two resistance bodies are alternatively stacked over one after another between the insulation plates.

2. The air conditioner blower motor driving resistor of claim 1, wherein said resistor unit comprises a first independent resistance body and a second independent resistance body obtained by combining two resistance bodies with each other.

3. The air conditioner blower motor driving resistor of claim 1, wherein said resistor unit in the resistor is formed with a three-layer resistance body.

4. The air condition blower motor driving resistor of claim 1, wherein a material of the resistance bodies in the resistor is an iron-nickel alloy.

5. The air conditioner blower motor driving resistor of claim 1, wherein said temperature fuse protects an inner circuit by short circuiting during overheat through the resistance bodies.

6. The air conditioner blower motor driving resistor of claim 1, wherein said thermal radiator is connected and fixed to a common terminal of the resistance bodies at a side of the cover member.

7. A resistor for driving a motor for an air conditioner blower, the air conditioner blower motor driving resistor comprising:

a resistor unit obtained by stacking insulation plates and resistance bodies alternately over one after another, in an inner accommodating area while combining protrusions of a resistor cover member forming an accommodating space with a thermal radiator;

a connector unit on the lower portion of which power source terminals are covered with a connector cover member and on the upper portion of which terminals soldered and connected with the resistance bodies stand erect; and a temperature fuse having a first and a second terminal, wherein the first terminal of said temperature fuse is fixed with a bolt to a ring-shaped terminal at an outer upper portion of the thermal radiator, to thereby enable a circuit to be formed through the thermal radiator, and wherein a second terminal of said temperature fuse is connected to a negative terminal of the connector, wherein the resistor unit comprises a first independent resistance body and a second independent resistance body obtained by combining two resistance bodies.

8. The air conditioner blower motor driving resistor of claim 7, wherein the resistor unit in the resistor is formed with a three-layer resistance body.

9. The air conditioner blower motor driving resistor of claim 7, wherein said temperature fuse protects an inner circuit by short circuiting during overheat through the resistance bodies.

10. The air conditioner blower motor driving resistor of claim 7, wherein said thermal radiator is connected and fixed to a common terminal of the resistance bodies at a side of the cover member.

11. A resistor for driving a motor for an air conditioner blower, the air conditioner blower motor driving resistor comprising:

a resistor unit obtained by stacking insulation plates and resistance bodies alternately over one after another, in an inner accommodating area while combining protrusions formed along the upper and left and right portions of a resistor cover member forming an accommodating space with a thermal radiator;

a connector unit on the lower portion of which power source terminals are covered with a connector cover member and on the upper portion of which terminals soldered and connected with the resistance bodies stand erect; and a temperature fuse which is short circuited during overheat through the resistance bodies, in order to protect an inner circuit, wherein one terminal of the temperature fuse is fixed with a bolt to a ring-shaped terminal at the outer upper portion of the thermal radiator, to thereby enable a circuit to be formed through the thermal radiator, wherein the thermal radiator is connected and fixed to the common terminal of the resistance bodies at the side of the cover member, and wherein the other terminal of the temperature fuse is connected to the negative terminal of the connector unit, wherein at least two resistance bodies are alternatively stacked over one after another between the insulation plates.

12. The air conditioner blower motor driving resistor of claim 11, wherein the resistor unit comprises a first independent resistance body and a second independent resistance body obtained by combining two resistance bodies with each other.

13. The air conditioner blower motor driving resistor of claim 11, wherein the resistor unit in the resistor is formed with a three-layer resistance body.

* * * * *